United States Patent [19]

Wahlfahrt

[11] 4,421,801

[45] Dec. 20, 1983

[54] DECORATION STAND IN THE FORM OF A CHRISTMAS TREE

[76] Inventor: Harald Wahlfahrt, Herrngasse 2, 8803 Rothenburg ob der Tauber, Fed. Rep. of Germany

[21] Appl. No.: 442,119

[22] Filed: Nov. 16, 1982

[30] Foreign Application Priority Data

Apr. 1, 1982 [DE] Fed. Rep. of Germany ... 8209353[U]

[51] Int. Cl.[3] ..... A47G 33/06

[52] U.S. Cl. ..... 428/19; 211/205

[58] Field of Search ..... 428/18, 19, 20, 8; 211/196–205; 362/123

[56] References Cited

U.S. PATENT DOCUMENTS 735,010 7/1903 Zahl ..... 428/20 X 3,674,612 7/1972 Gehl, Jr. ..... 428/19 X

*Primary Examiner*—Henry F. Epstein

*Attorney, Agent, or Firm*—Thomas & Kennedy

[57] ABSTRACT

A decoration stand in the form of a Christmas tree includes an upright middle support 1 with branches and needles 3 extending substantially in a common plane on opposite sides of the middle support, and hangers, supports and shelf-like boards 4 occupy the decoration stand and are supported by the middle support 1 or branches 3 to serve for the exhibition of articles to be displayed.

4 Claims, 3 Drawing Figures

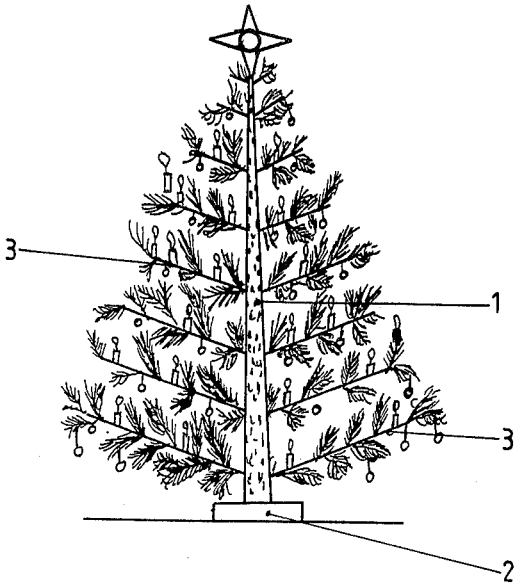
Fig.1
Fig. 3
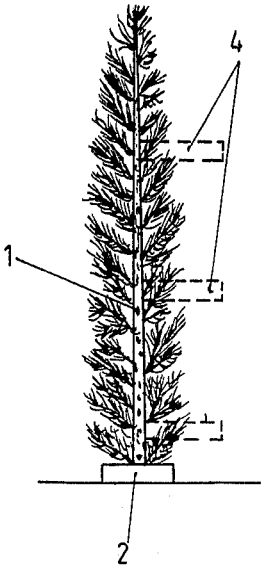
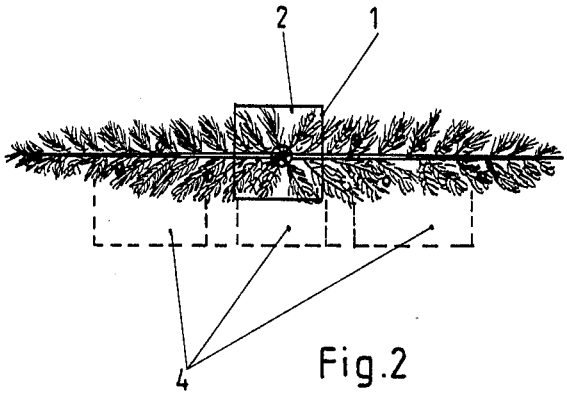
Fig.2

DECORATION STAND IN THE FORM OF A CHRISTMAS TREE

The invention relates to a decoration stand in the form of a Christmas tree for use in stores, show windows, etc. Usually there is not sufficient space in such places to set up a complete Christmas tree, even if its branches and needles consist only of imitations. However, in order to be able to set up a Christmas tree as a decoration or as a stand for displaying articles at Christmas time, independently of the limited space conditions, it is proposed according to the invention to arrange the branch and needle imitations forming the Christmas tree running solely in one plane on a middle support provided with a foot, forming the trunk of the Christmas tree, and decorated with branch and needle imitations which run in a single plane and in respectively opposite directions.

Preferably in this case carriers or shelf-like supports for the display of articles are fastened to the middle support or to the branches.

The decoration stand according to the invention is illustrated in an embodiment in the attached drawings, in which are shown:

FIG. 1: a front view of the decoration stand, and

FIGS. 2 and 3: a plan view or side view, respectively, of the decoration stand according to FIG. 1.

As can be seen from the figures, the decoration stand has in front view (FIG. 1) the appearance of a Christmas tree, with a middle support 1 provided with a foot 2 and forming the trunk of the Christmas tree, and decorated on both sides, but lying only in one plane, with branch and needle imitations 3.

As shown in FIGS. 2 and 3, the branch and needle imitations extend only in a single plane. The decoration stand can be occupied over its surface with hangers, supports, shelf-like boards, or the like 4, which are fastened to the middle support 1 or to the branches 3.

These supports are indicated by dashed lines in FIGS. 2 and 3. In any desired arrangement, they serve for the exhibition of articles to be displayed, of any kind. On the other hand it is also possible to decorate the branches 3 in the usual way like a Christmas tree with candles, ornaments, and other hangings.

When not in use, the whole decoration stand can be put away with little space requirement and stored for further use.

I claim:

1. A decoration stand in the approximate form of a Christmas tree comprising a base, an upright middle support mounted at its lower end portion to said base, a plurality of branches with needles extending therefrom, each of said branches mounted at one of its end portions to said middle support and extending laterally from said middle support, with some branches extending on one side of said middle support and with other branches extending on the other side of said middle support, said branches and said middle support all positioned in a common upright plane to form an outline of a Christmas tree, a plurality of article display members extending out of a common plane of the branches and middle support for exhibiting articles adjacent the outline of the Christmas tree.

2. The decoration stand of claim 1 and wherein said article display members comprise shelf-like supports mounted to said middle support and to said branches and extending on one side of the common plane.

3. The decoration stand of claim 1 and wherein said article display members are spaced vertically from one another.

4. The decoration stand of claim 1 and wherein said article display members are mounted to said middle support, and project from the middle support only on one side of the common plane, and are vertically spaced from one another.

* * * * *